US011213883B2

(12) United States Patent
Sakazawa et al.

(10) Patent No.: US 11,213,883 B2
(45) Date of Patent: Jan. 4, 2022

(54) CASTING DEVICE, METHOD FOR MANUFACTURING CASTING, AND SEAL STRUCTURE

(71) Applicant: Ahresty Corporation, Toyohashi (JP)

(72) Inventors: Toshiyuki Sakazawa, Toyohashi (JP); Shigeyoshi Komaki, Toyohashi (JP); Takanori Takahashi, Toyohashi (JP)

(73) Assignee: AHRESTY CORPORATION, Toyohashi (JP)

( * ) Notice: Subject to any disclaimer, the term of this patent is extended or adjusted under 35 U.S.C. 154(b) by 0 days.

(21) Appl. No.: 16/647,999

(22) PCT Filed: Apr. 12, 2018

(86) PCT No.: PCT/JP2018/015454
§ 371 (c)(1),
(2) Date: Mar. 17, 2020

(87) PCT Pub. No.: WO2019/198218
PCT Pub. Date: Oct. 17, 2019

(65) Prior Publication Data
US 2020/0282455 A1 Sep. 10, 2020

(51) Int. Cl.
*B22D 17/14* (2006.01)
*B22D 17/20* (2006.01)
*B22D 17/32* (2006.01)

(52) U.S. Cl.
CPC ..... *B22D 17/14* (2013.01); *B22D 17/2038* (2013.01); *B22D 17/32* (2013.01)

(58) Field of Classification Search
CPC ..... B22D 17/08; B22D 17/14; B22D 17/20; B22D 17/2015; B22D 17/2023;
(Continued)

(56) References Cited

U.S. PATENT DOCUMENTS 9,630,245 B2 4/2017 Furutani et al.
2015/0273574 A1 10/2015 Furutani et al.

FOREIGN PATENT DOCUMENTS

CN 101460269 A 6/2009
CN 104884191 A 9/2015
(Continued)

OTHER PUBLICATIONS

Office Action dated Jan. 25, 2021, issued in counterpart CN Application No. 201880059050.3, with English translation. (10 pages).
(Continued)

*Primary Examiner* — Kevin P Kerns
(74) *Attorney, Agent, or Firm* — Westerman, Hattori, Daniels & Adrian, LLP

(57) ABSTRACT

A casting device for operating stably while suppressing leakage from a gap between a tip and a sleeve is disclosed. The casting device includes: a sliding member in the center of which a rod slides, and in which a gap is formed between the rod and the sleeve; a seal member arranged at an outer periphery of the sliding member; and a suction device for suctioning air inside the sleeve. When the seal member is positioned in a center section closer to a cavity than a pouring hole, and the air in a space between the sliding member and the tip is suctioned, the seal member assumes a first state in which the seal member adheres to the center section, and in the first state, the tip advances toward the cavity.

14 Claims, 8 Drawing Sheets

(58) Field of Classification Search
CPC .. B22D 17/203; B22D 17/2038; B22D 17/30; B22D 17/32
USPC ..... 164/303, 312
See application file for complete search history.

(56) References Cited

FOREIGN PATENT DOCUMENTS

| | | | |
|---|---|---|---|
| CN | 106061653 | A | 10/2016 |
| DE | 69032853 | T2 | 7/1999 |
| EP | 2058065 | A1 | 5/2009 |
| EP | 3057726 | B1 | 4/2020 |
| JP | S61-289955 | A | 12/1986 |
| JP | 2004268051 | A | 9/2004 |
| JP | 2006-181626 | A | 7/2006 |
| JP | 4646622 | B2 | 3/2011 |
| JP | 2011-206827 | A | 10/2011 |
| JP | 5454068 | B2 | 3/2014 |
| JP | 2013/098917 | A1 | 4/2015 |
| JP | 2015-214140 | A | 12/2015 |
| WO | 2013/098917 | A1 | 7/2013 |

OTHER PUBLICATIONS

International Search Report dated Jul. 10, 2018, issued in counterpart application No. PCT/JP2018/015454, w/English translation (3 pages).
Asai,"Injection apparatus for vacuum die casting", JIII (Japan Institute of Invention and Innovation), Journal of Technical Disclosure No. 2006-504829, Sep. 1, 2006, w/English translation, Cited in Specification (3 pages).
International Preliminary Report on Patentability (Form PCT/IB/373) issued in counterpart International Application No. PCT/JP2018/015454 dated Oct. 13, 2020 with Form PCT/ISA/237. (6 pages).
Extended European Search Report dated Jul. 24, 2020, issued in counterpart Application No. 18914758.0(14 pages).
Office Action dated Apr. 1, 2021, issued in counterpart IN Application No. 202017010003, with English Translation. (7 pages).
Office Action dated Apr. 19, 2021, issued in counterpart EP Application No. 18 914 758.0. (5 pages).

CASTING DEVICE, METHOD FOR MANUFACTURING CASTING, AND SEAL STRUCTURE

TECHNICAL FIELD

The present invention relates to a casting device, a method for manufacturing a casting, and a seal structure.

BACKGROUND ART

As a technology for preventing blowholes and incomplete fusions from arising when air is leaked from a gap between a tip and a sleeve and blown into a molten metal during the decompression of a mold cavity, a technology for disposing a piston integrally with the tip and stopping the piston at a fixed position at the time of injection is disclosed in Non-Patent Literature 1. According to this disclosed technology, a decompression space is formed between the tip and the piston at the time of injection, and leakage from a gap between the tip and the sleeve can be prevented.

CITATION LIST

Non-Patent Literature

Non-Patent Literature 1: JIII (Japan Institute of Invention and Innovation) Journal of Technical Disclosure No. 2006-504829

Patent Literature

Patent Literature 1: Japanese Unexamined Patent Application Publication No. 2011-206827

SUMMARY OF INVENTION

Technical Problems

However, when the technology disclosed in Non-Patent Literature 1 is adopted, it is demanded that the piston provide airtightness for achieving a degree of vacuum required in the decompression space formed between the tip and the piston and assure smooth sliding in the sleeve (slidability). Airtightness and slidability are in a trade-off relationship where one quality is sacrificed in return for a gain in another quality. Airtightness and slidability depend on a delicate balance. Thus, it is difficult to adjust the balance between airtightness and slidability. Further, operating a device may easily affect the balance between airtightness and slidability and impair their properties. Furthermore, thermal deformation occurs to warp both longitudinal ends of the sleeve upward due to the temperature difference between the lower part of the sleeve where a molten metal accumulates during pouring and the upper part of the sleeve where a space is created (Patent Literature 1). This incurs leakage at an early stage and adversely affects the motion of the piston. Consequently, problems occur to prevent a stable operation from being performed.

The present invention has been made to solve the above-described problems. An object of the present invention is to provide a casting device, a method for manufacturing a casting, and a seal structure that make it possible to perform a stable operation while reducing the leakage from the gap between the tip and the sleeve.

Solution to Problems

In accomplishing the above object, a casting device according to the present invention includes a sleeve, a tip, a rod, an injection device, a sliding member, a seal member, and a suction device. The sleeve communicates with a cavity of a mold to be decompressed, and has a pouring hole. The tip is to be inserted into the sleeve. The rod is to be mounted on the tip. The injection device applies a force to the tip via the rod. The sliding member allows the rod to slide centrally to form a gap relative to the sleeve. The seal member is disposed on the outer circumference of the sliding member. The suction device suctions air in the sleeve. When air in a space between the tip and the sliding member in the sleeve is suctioned while the seal member is positioned in a middle section of the sleeve that is positioned toward the cavity rather than toward the pouring hole, the seal member is placed in a first state where the seal member adheres to the middle section. Before the air in the space is suctioned while the seal member is positioned in the middle section, the seal member is placed in a second state where the seal member receives a smaller force from the middle section than the force received from the middle section by the seal member in the first state. In the first state, the tip advances toward the cavity.

A method for manufacturing a casting in accordance with the present invention includes a pouring step, an advancing step, a suction step, and an injection step. The pouring step supplies a molten metal to a sleeve from a pouring hole in the sleeve, which communicates with a cavity of a mold. The advancing step advances a sliding member until the sliding member is positioned in a middle section positioned toward the cavity rather than toward the pouring hole and a tip is positioned toward the cavity rather than toward the middle section. The sliding member allows the tip and a rod to slide in the center. The rod is mounted on the tip. The suction step suctions air in a space between the tip and the sliding member in the sleeve while the advance of the sliding member toward the cavity is restricted after the sliding member is advanced in the advancing step, and places a seal member in a first state where the seal member adheres to the middle section. The seal member is disposed on the outer circumference of the sliding member. The injection step decompresses the cavity, advances the tip toward the cavity via the rod in the first state, and injects the molten metal in the sleeve into the cavity. In the advancing step, the seal member is placed in a second state where the seal member receives a smaller force from the middle section than the force received from the middle section in the first state.

A seal structure according to the present invention is used for a casting device. The seal structure includes a first member, a second member, and a seal member. The first member is configured such that a cross-section orthogonal to a central axis has a circular outer circumferential surface. The second member is configured such that a cross-section orthogonal to a central axis has a circular inner circumferential surface, and that the inner circumferential surface is disposed with a gap radially oriented with respect to the outer circumferential surface of the first member. The seal member is disposed on one of the first and second members. When air in the gap is suctioned, the seal member is placed in a first state where the seal member closes the gap by adhering to the other one of the first and second members. Before the air in the gap is suctioned, the seal member is placed in a second state where the seal member receives a smaller force from the other one of the first and second members than the force received from the other one of the first and second members in the first state. In the second state, the first and second members relatively move toward the central axes.

Advantageous Effects of Invention

According to the casting device of a first aspect, a gap is formed between the sliding member and the sleeve. When the air in the space between the tip and the sliding member in the sleeve is suctioned while the seal member is positioned in the middle section of the sleeve that is positioned toward the cavity rather than toward the pouring hole, the seal member is placed in the first state where the seal member adheres to the middle section. Meanwhile, before the air in the space is suctioned while the seal member is positioned in the middle section, airtightness is not required. Therefore, the seal member is placed in the second state where the seal member receives a smaller force from the middle section than the force received from the middle section in the first state. This makes it possible to reduce the friction of the seal member when the sliding member moves in the sleeve. Thus, even when thermal deformation occurs to warp the sleeve in the longitudinal direction, the sliding member is able to smoothly move in the sleeve. As a result, the seal member can be positioned in the middle section to advance the tip toward the cavity in the first state. Consequently, a stable operation can be performed while reducing the leakage of air into the cavity from the gap between the tip and the sleeve.

If the seal member is not in contact with the middle section in the second state, the seal member receives a force of zero from the middle section. Meanwhile, in the first state, the seal member receives a force greater than zero from the middle section. Therefore, a state where the seal member receives a force of zero from the middle section also corresponds to the second state.

According to the casting device of a second aspect, there is a gap between the seal member and the middle section in the second state. Consequently, in addition to the advantageous effects of the first aspect, it is possible to further reduce the wear of the seal member. Further, the seal member is not easily affected by thermal conduction from the middle section to the seal member. This makes it possible to inhibit the seal member from being thermally degraded.

According to the casting device of a third aspect, the seal member is a belt-like member having a first edge and a second edge. A first-edge portion of the seal member adheres to the entire circumference of the sliding member. The second edge is disposed toward the injection device rather than toward the first edge and is released. Therefore, when the air in the space is suctioned, an airflow occurs in the gap between the sleeve and the sliding member so that a second-edge portion of the seal member is suctioned by the airflow and adhered to the sleeve. Consequently, in addition to the advantageous effects of the first and second aspects, it is easy to change the degree of adhesion of the seal member to the sleeve.

According to the casting device of a fourth aspect, the ends of the seal member gradually decrease in thickness toward a circumferential end and then abut on each other. Therefore, when the second-edge portion of the seal member is suctioned and adhered to the sleeve, no gap is likely to arise relative to the second-edge portion of the ends. Consequently, in addition to the advantageous effects of the third aspect, it is possible to improve airtightness.

According to the casting device of a fifth aspect, the sliding member is configured such that a concave is formed inside the second edge of the seal member, and that a gap exists between the concave and at least a part of the second edge in the second state. Therefore, a part of the airflow generated in the gap between the sleeve and the sliding member enters the concave to push the second-edge portion of the seal member out toward the sleeve. Consequently, in addition to the advantageous effects of the third and fourth aspects, it is possible to improve the reliability of airtightness of the seal member.

According to the casting device of a sixth aspect, the sliding member includes a convex disposed on the outer circumference that is positioned toward the injection device rather than toward the seal member. The outer edge of the convex is positioned radially inward of the outer edge of the seal member in the first state. The outer edge of the convex is positioned radially outward of the outer edge of the seal member in the second state. Therefore, when, for example, the sliding member retreats in the sleeve, metal pieces, cast burrs, and the like (hereinafter referred to as the foreign matter), which are generated when a molten metal solidifies outside the sleeve at the time of pouring, are unlikely to reach the seal member. Consequently, in addition to the advantageous effects of the first to fifth aspects, it is possible to inhibit the seal member from being damaged by the foreign matter.

According to the casting device of a seventh aspect, the foreign matter existing in the pouring hole and its vicinity can be removed by a first blowing device adapted to blow air into the pouring hole. As a result, when, for example, the sliding member advances within the pouring hole, the foreign matter is unlikely to be trapped between the sliding member and the sleeve. Consequently, in addition to the advantageous effects of the first to sixth aspects, it is possible to reduce the possibility of malfunction due to the foreign matter trapped between the sliding member and the sleeve.

According to the casting device of an eighth aspect, the inner circumferential surface of a trailing end of the sleeve that is adjacent to the pouring hole and positioned toward the injection device is configured such that a first section overlaps with the pouring hole in the direction of the central axis of the sleeve, and that a second section is adjacent to the first section in the circumferential direction of the sleeve, and further that the outer circumferential surface of the tip is in contact with the second section. The distance between the first section and the central axis of the sleeve is longer than the distance between the second section and the central axis. Therefore, even when the foreign matter is left on the tip in the pouring hole, the air blown from the first blowing device makes it easy to remove the foreign matter from the first section. Consequently, in addition to the advantageous effects of the seventh aspect, it is possible to further reduce the possibility of malfunction due to the foreign matter trapped between the sliding member and the sleeve.

According to the casting device of a ninth aspect, an end member is disposed on an end of the sleeve that is positioned toward the injection device. The inner surface of the end member that faces the central axis of the sleeve is configured such that a third section overlaps with a part of the range over which the pouring hole is extended toward the injection device along the central axis, and that a fourth section is adjacent to the third section in the circumferential direction of the sleeve. The distance between the third section and the central axis is longer than the distance between the fourth section and the central axis. Therefore, the air blown from the first blowing device makes it easy to remove the foreign matter from the third section. Consequently, in addition to the advantageous effects of the eighth aspect, it is possible to further reduce the possibility of malfunction due to the foreign matter trapped between the sliding member and the sleeve.

According to the casting device of a tenth aspect, a second blowing device blows air to the sliding member protruded from an end of the sleeve that is positioned toward the injection device. Consequently, in addition to the advantageous effects of the first to ninth aspects, it is possible to remove the foreign matter attached to the sliding member and cool the sliding member.

According to the casting device of an eleventh aspect, a groove is formed in the end member to provide passage of the air blown from the second blowing device. At least a part of the groove is extended in the circumferential direction of the sleeve. Therefore, the air can be blown widely in the circumferential direction to the tip and a portion of the sliding member that is positioned outside the sleeve. Consequently, in addition to the advantageous effects of the ninth aspect, it is possible to further remove the foreign matter and cool the sliding member.

According to the casting device of a twelfth aspect, an air filter is disposed in a piping connected to the suction device. Consequently, in addition to the advantageous effects of the first to eleventh aspects, it is possible to prevent any foreign matter in suctioned air from reaching the suction device.

According to the casting device of a thirteenth aspect, a stepper is disposed toward the injection device rather than toward the sliding member, and the stopper and the sliding member are coupled to a coupling member. The stopper comes into contact with a first stopper in order to restrict the advance of the sliding member toward the cavity rather than toward the middle section. A second stopper is disposed toward the injection device rather than toward the first stopper. The stopper comes into contact with the second stopper in order to restrict the retreat of the sliding member toward the injection device. This makes it possible to mechanically restrict the positions to which the sliding member advances and retreats. The sliding member moves together with the rod due to the friction between the sliding member and the outer circumferential surface of the rod. When retreating toward the injection device rather than toward the pouring hole, the tip stops at a position where a gap exists between the sliding member stopped due to the contact between the second stopper and the stopper and a surface of the tip that is positioned toward the sliding member. Consequently, in addition to the advantageous effects of the first to twelfth aspects, the foreign matter is unlikely to be trapped between the sliding member and the tip.

According to the casting device of a fourteenth aspect, the sleeve is configured such that a suction port is formed toward the cavity rather than toward the pouring hole and connected to the suction device. The middle section is positioned between the pouring hole and the suction port. Consequently, in addition to the advantageous effects of the first to thirteenth aspects, it is possible to simplify a mechanism for suctioning the air in the space.

According to the method for manufacturing a casting of a fifteenth aspect, the pouring step supplies a molten metal to the sleeve from the pouring hole in the sleeve, which communicates with the cavity of a mold. In the advancing step, the sliding member, which allows the rod-attached tip and the rod to slide in the center, advances until the sliding member is positioned in the middle section positioned toward the cavity rather than toward the pouring hole and the tip is positioned toward the cavity rather than toward the suction port. In the suction step, while the advance of the sliding member toward the cavity is restricted, the air in the space between the tip and the sliding member in the sleeve is suctioned so that the seal member disposed on the outer circumference of the sliding member is placed in the first state where the seal member adheres to the middle section. Therefore, the pressure in the space can be reduced. In the injection step, while the cavity is decompressed in the first state, the tip advances toward the cavity via the rod so that the molten metal in the sleeve is injected into the cavity. This makes it possible to reduce the leakage of air into the cavity from the gap between the tip and the sleeve.

In the advancing step, the second state occurs so that the seal member receives a smaller force from the middle section than the force received by the seal member from the middle section in the first state. Therefore, even when thermal deformation occurs to warp the sleeve in the longitudinal direction, the sliding member is able to smoothly move in the sleeve. This makes it possible to perform a stable operation.

According to the method for manufacturing a casting of a sixteenth aspect, before the sliding member reaches the pouring hole in the advancing step, air is blown to the inside of the pouring hole in a first blowing step. This makes it possible to remove the foreign matter existing in the pouring hole and its vicinity. As a result, when, for example, the sliding member advances within the pouring hole, the foreign matter is unlikely to be trapped between the sliding member and the sleeve. Consequently, in addition to the advantageous effects of the fifteenth aspect, it is possible to reduce the possibility of malfunction due to the foreign matter trapped between the sliding member and the sleeve.

According to the method for manufacturing a casting of a seventeenth aspect, a retreat step is performed after the injection step in order to retreat the tip and the sliding member. In the retreat step, a second blowing step is performed to blow air to a portion outside the sleeve of at least one of the tip and the sliding member. Consequently, in addition to the advantageous effects of the fifteenth and sixteenth aspects, it is possible to remove the foreign matter and cool the sliding member.

According to the method for manufacturing a casting of an eighteenth aspect, the second state occurs in the retreat step. Consequently, in addition to the advantageous effects of the fifteenth and sixteenth aspects, the sliding member can be retreated even when thermal deformation occurs to warp the sleeve in the longitudinal direction.

According to the seal structure of a nineteenth aspect, a gap is formed between the outer circumferential surface of the first member and the inner circumferential surface of the second member. The seal member is disposed on one of the first and second members. When the air in the gap is suctioned, the seal member is placed in the first state where the seal member closes the gap by adhering to the other one of the first and second members. Before the air in the gap is suctioned, the seal member is placed in the second state where the seal member receives a smaller force from the other one of the first and second members than the force received from the other one of the first and second members in the first state. In the second state, the first and second members relatively move toward the central axes. This makes it possible to not only achieve airtightness in the first state, but also reduce the fiction of the seal member when the first and second members relatively move.

When the seal member is not in contact with the other one of the first and second members in the second state, the seal member receives a force of zero from the other one of the first and second members. Meanwhile, in the first state, the seal member receives a force greater than zero from the other one of the first and second members. Therefore, a state where the seal member receives a force of zero from the other one of the first and second members also corresponds to the second state.

BRIEF DESCRIPTION OF DRAWINGS

FIG. 2(*b*) is a cross-sectional view of the casting device taken along line IIb-IIb in FIG. 1.

FIG. 4(*b*) is a cross-sectional view illustrating the casting device during an injection step.

FIG. 7(*b*) is a correlation diagram illustrating the relationship between the pressure difference between the cavity and the space and the mass of a molten metal drawn into the cavity.

DESCRIPTION OF EMBODIMENTS

Figure 1:
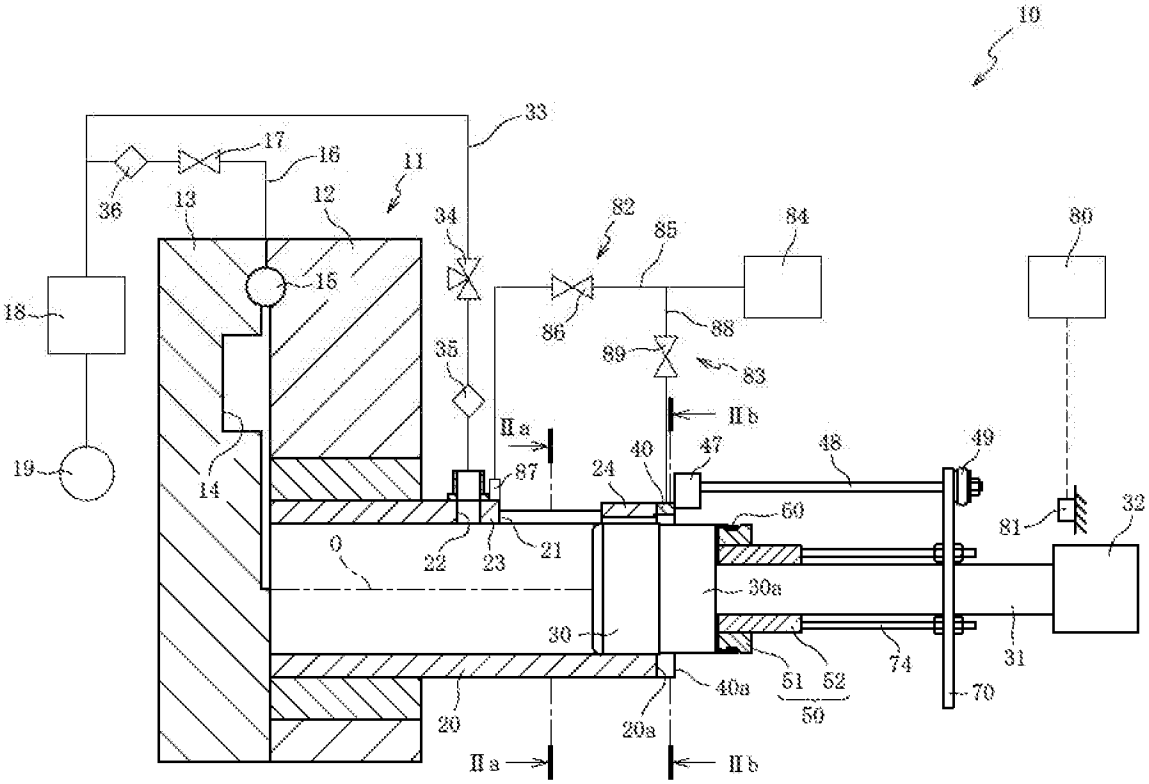
FIG. 1 is a cross-sectional view of a casting device according to a first embodiment of the present invention.

Preferred embodiments of the present invention will be described with reference to the accompanying drawings. First of all, a casting device 10 according to a first embodiment will be described with reference to FIG. 1. FIG. 1 is a cross-sectional view of the casting device 10 that includes a central axis O of a sleeve 20. The casting device 10 includes the sleeve 20 (second member), a tip 30, and a sliding member 50 (first member). The sleeve 20 is mounted on a mold 11. The tip 30 is to be inserted into the sleeve 20. The casting device 10 performs casting by advancing the tip 30 in the sleeve 20 and injecting a molten metal (e.g., aluminum alloy) into the mold 11.

The mold 11 includes a fixed mold 12 and a movable mold 13. The fixed mold 12 and the movable mold 13 are used to form a cavity 14 for molding a casting (die-cast product). A stop valve 15 is connected to a flow path that communicates with the cavity 14 of the mold 11. A first piping 16 is connected to the stop valve 15. A first valve 17 is disposed in the first piping 16. In order to decompress the cavity 14, a vacuum pump 19 is connected downstream of the first valve 17 via a decompression tank 18. An air filter 36 is disposed between the first valve 17 and the decompression tank 18.

The sleeve 20 (second member) is a cylindrical member that is fastened at its leading end to the fixed mold 12 and adapted to communicate with the cavity 14. A cross-section of the sleeve 20 that is orthogonal to the central axis O has a circular inner circumferential surface. A pouring hole 21 is formed in the sleeve 20 and used to supply a molten metal to the sleeve 20. The tip 30 is a cylindrical member that is to be inserted into the sleeve 20. A rod 31 is coaxially mounted on the tip 30 via a coupling 30*a*. The rod 31 is a member that transmits a pushing force or a pulling force to the tip 30, and is operated by an injection device 32 that includes, for example, a hydraulic cylinder and an accumulator. The tip 30 mounted on the leading end of the rod 31 via the coupling 30*a* advances (moves toward the cavity 14) and retreats (moves toward the injection device 32) in the sleeve 20 along the central axis O under the control of the injection device 32. The coupling 30*a* has a smaller diameter than the tip 30 and a larger diameter than the rod 31.

The sleeve 20 is configured such that a suction port 22 is formed in a middle section 23 positioned toward the cavity 14 rather than toward the pouring hole 21. The suction port 22 is disposed at intervals toward the pouring hole 21 and the central axis O. The suction port 22 is an opening for suctioning air in the sleeve 20. The suction port 22 is connected to a second piping 33 in which a second valve 34 is disposed. The second piping 33 is connected to the decompression tank 18 downstream of the second valve 34.

The second valve 34 is a three-way valve that is able to choose one of three options, namely, the option of interrupting the communication between the suction port 22 and the decompression tank 18, the option of establishing communication between the suction port 22 and the decompression tank 18, and the option of interrupting the communication between the suction port 22 and the decompression tank 18 and opening the suction port 22 to air pressure. The second piping 33 is configured such that an air filter 35 is disposed between the suction port 22 and the second valve 34. Operations of the first valve 17 and the second valve 34 are controlled by a control device 80 (described later).

Figure 2A:
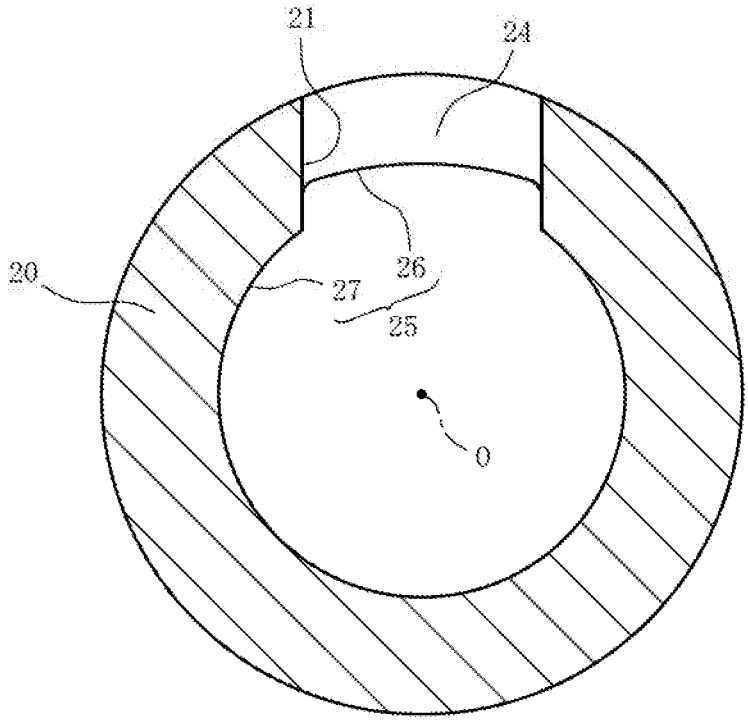
FIG. 2(*a*) is a cross-sectional view of the casting device taken along line IIa-IIa in FIG. 1.
Figure 2B:
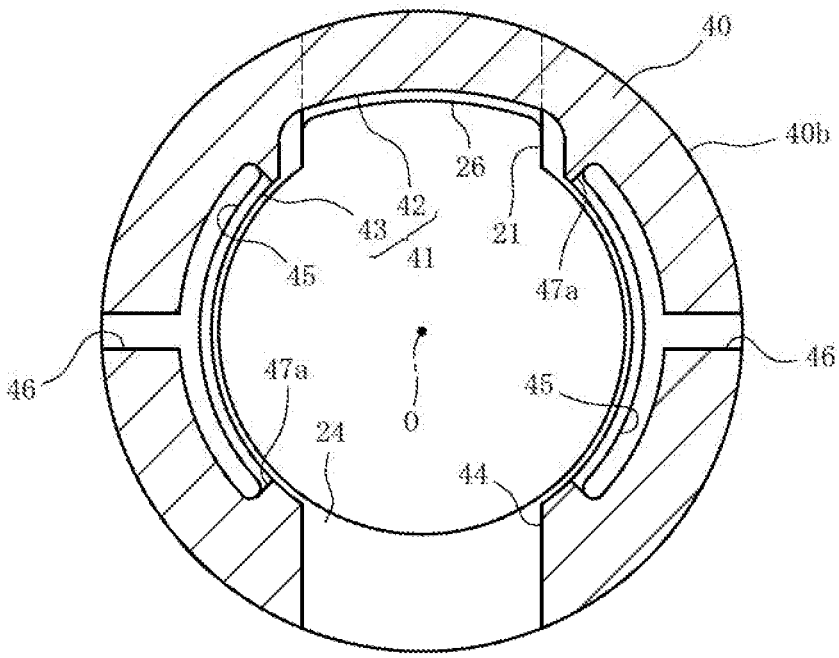

FIG. 2(*a*) is a cross-sectional view of the casting device 10 taken along line IIa-IIa in FIG. 1. An inner circumferential surface 25 of a trailing end 24 of the sleeve 20 that is adjacent to the pouring hole 21 and positioned toward the injection device 32 includes a first section 26 and a second section 27. The first section 26 overlaps with the pouring hole 21 in the direction of the central axis O. The second section 27 is adjacent to both sides of the first section 26 in the circumferential direction of the sleeve 20. The second section 27 is in contact with the outer circumferential surface of the tip 30. The distance between, the first section 26 and the central axis O is longer than the distance between the second section 27 and the central axis O. More specifically, the first section 26 is radially concave with respect to the second section 27. Therefore, while the tip 30 is in contact with the second section 27, the first section 26 is separated from the tip 30.

FIG. 2(*b*) is a cross-sectional view of the casting device 10 taken along line IIb-IIb in FIG. 1. An end member 40 is disposed on a trailing end face 20*a* of the sleeve 20. In the present embodiment, the end member 40 has an annular inner surface 41. The inner surface 41 of the end member 40 includes a third section 42 and a fourth section 43. The third section 42 partly overlaps with the pouring hole 21 in the direction of the central axis O and has a greater width (circumferential length) than the pouring hole 21. The fourth section 43 is adjacent to both circumferential sides of the third section 42. The distance between the third section 42 and the central axis O of the sleeve 20 is longer than the distance between the fourth section 43 and the central axis O. More specifically, the third section 42 is radially concave with respect to the fourth section 43. The outside diameter of the end member 40 is set to be equal to or smaller than the outside diameter of the sleeve 20 in order to prevent the interference between the end member 40 and, for example, a ladle (not shown).

The distance between the third section 42 of the end member 40 and a central axis O is longer than the distance between the first section 26 of the sleeve 20 and the central axis O. More specifically, when viewed in the direction of the central axis O, the third section 42 is radially concave with respect to the first section 26. The end member 40 is configured such that a fifth section 44 is positioned opposite the third section 42 with the central axis O sandwiched between the fifth section 44 and the third section 42. The material of the end member 40 is removed from the fifth section 44 along its entire radial length. A circumferentially extended groove 45 is formed in the end member 40. In the present embodiment, the groove 45 is formed between the third section 42 and the fifth section 44, and open in a trailing end face 40*a* of the end member 40. The groove 45 is connected to a hole 46 that is open in the outer circumferential surface 40*b* of the end member 40. The groove 45 is open in the inner circumferential surface of the end member 40 and continued to a circumferentially extended groove 47*a*.

Returning to FIG. 1, the following description is given. A first stopper 47 is fastened to the end member 40. The first stopper 47 is a member that restricts the advance of the sliding member 50. The rod 31 slides through the center of the sliding member 50. A rod-shaped arm 48 extended linearly toward the injection device 32 is fastened to the first stopper 47. A second stopper 49 is fastened to the trailing end of the arm 48. The second stopper 49 is a member that restricts the retreat of the sliding member 50.

The sliding member 50 (first member) includes a first cylindrical body 51 and a second cylindrical body 52. The first cylindrical body 51 is formed of metal and cylindrically shaped. A seal member 60 is fastened to the outer circumference of the first cylindrical body 51. The second cylindrical body 52 is formed of metal and disposed inside the first cylindrical body 51. The rod 31 slides through the center of the second cylindrical body 52. An airtight seal is provided between the rod 31 and the second cylindrical body 52.

The first cylindrical body 51 is configured such that a cross-section orthogonal to the central axis O has a circular outer circumferential surface. The outside diameter of the first cylindrical body 51 is smaller than the inside diameter of the sleeve 20, and the outside diameter of the seal member 60 fastened to the first cylindrical body 51 is also smaller than the inside diameter of the sleeve 20. Therefore, the friction between the sliding member 50 and the sleeve 20 and the friction between the seal member 60 and the sleeve 20 are ignorable when the sliding member 50 moves in the sleeve 20. Consequently, the friction between the second cylindrical body 52 and the rod 31 causes the sliding member 50 to move together with the rod 31 when the rod 31 advances and retreats.

The sliding member 50 is configured such that the second cylindrical body 52, which causes friction with the rod 31, is fitted into the first cylindrical body 51 to which the seal member 60 is fastened. Therefore, when one member is worn, the sliding member 50 can be reassembled by replacing only the worn member. This improves the maintainability of the sliding member 50. Further, when the sleeve 20 is to be replaced by a sleeve having a different inside diameter, such replacement can be made by replacing only the first cylindrical body 51 without having to replace the entire sliding member 50.

Figure 3:
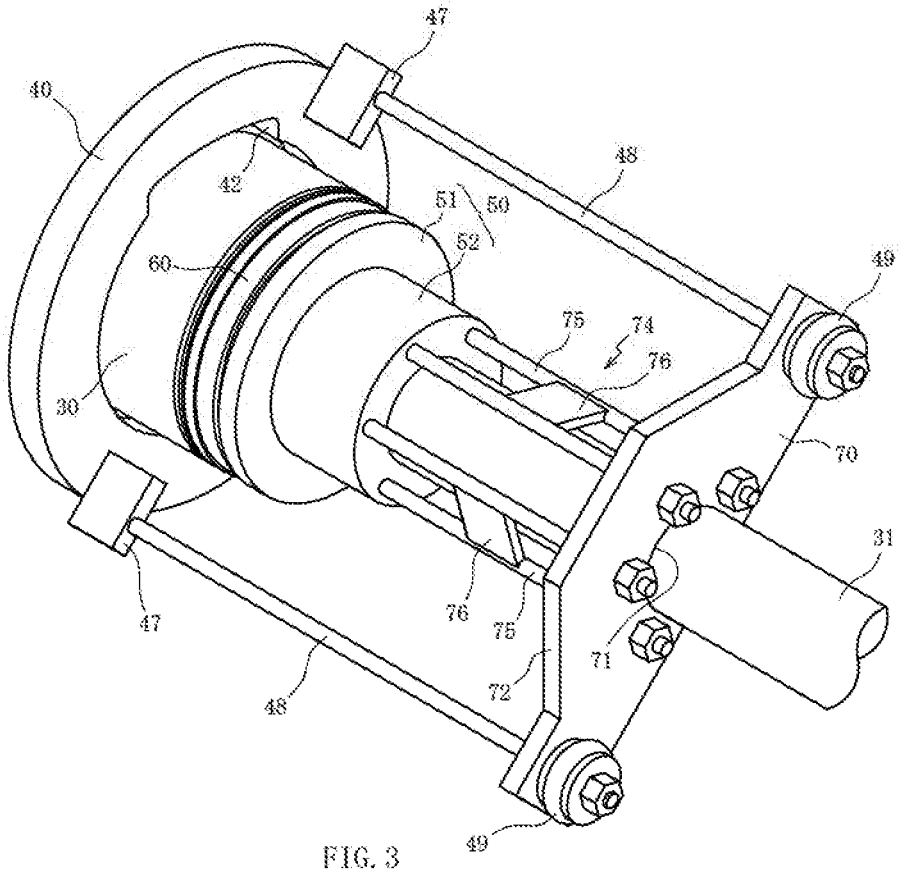
FIG. 3 is a perspective view of the casting device.

FIG. 3 is a perspective view of the casting device 10. In FIG. 3, the illustration of the trailing-end side of the rod 31 and the sleeve 20 is omitted. The sliding member 50 is configured such that a stopper 70 is secured by a coupling member 74 extended along the rod 31. The coupling member 74 is disposed on a trailing-end face of the second cylindrical body 52. In the present embodiment, the stopper 70 is a plate-like member having a first surface 71 and a second surface 72. The first surface 71 opposes the outer circumference of the rod 31, and is shaped concave. The second surface 72 is positioned opposite the first surface 71 and shaped convex. The first surface 71 faces a half of the outer circumference of the rod 31. Therefore, the stopper 70 can be replaced more easily than when the entire circumference of the rod 31 is surrounded by a stopper.

A hole (not shown) penetrating in the thickness direction is formed in the stopper 70. The arm 48 penetrates the hole. When the stopper 70 hits the second stopper 49, the retreat of the sliding member 50 becomes restricted. When the stopper 70 hits the first stopper 47, the advance of the sliding member 50 becomes restricted.

The coupling member 74 includes a plurality of rod-shaped first members 75 that are circumferentially disposed at intervals along the rod 31. Therefore, the coupling member 74 can be mounted around the rod 31 more easily than when the entire circumference of the rod 31 is surrounded by a coupling member. The coupling member 74 includes a plate-like second member 76 for coupling the first members 75 adjacent to each other. The second member 76 ensures that the first members 75 are unlikely to twist around the central axis O. This makes it possible to prevent the coupling member 74 from being damaged.

Returning to FIG. 1, the following description is given. The casting device 10 includes the control device 80 that controls the operations of a mold clamping device (not shown), an extrusion device (not shown), the injection device 32, a first blowing device 82 (described later), and a second blowing device 83 (described later). A displacement sensor 81 is disposed in the casting device 10 in order to detect the amount of displacement of the stopper 70 (i.e., the displacement amount of the sliding member 50) and output the result of detection to the control device 80. In the present embodiment, the displacement sensor 81 is a noncontact sensor that uses the reflection of laser light irradiated on the stopper 70. However, the displacement sensor 81 is not limited to such a sensor. A contact displacement sensor may obviously be used as the displacement sensor 81.

The first blowing device 82 blows air into the pouring hole 21. The first blowing device 82 includes a third piping 85, a nozzle 87, and a third valve 86. The third piping 85 is connected to an air source 84 including, for example, a compressor and an air tank. The nozzle 87 is connected to the end of the third piping 85. The third valve 86 is disposed in the third piping 85, which is positioned upstream of the nozzle 87. The third valve 86 opens and closes the third piping 85. The nozzle 87 is disposed on the outer circumference of the middle section 23 of the sleeve 20 and oriented toward the pouring hole 21 so as to blow air toward the injection device 32.

The second blowing device 83 blows air to the sliding member 50 protruded from the trailing end face 20*a* of the sleeve 20. The second blowing device 83 includes a fourth piping 88 and a fourth valve 89. The fourth piping 88 is connected to the air source 84. The fourth valve 89 is disposed in the fourth piping 88. The fourth valve 89 opens and closes the fourth piping 88. In the present embodiment, the fourth piping 88 is connected to the hole 46 (see FIG. 2(*b*)) formed in the end member 40 so that air is blown from the groove 45 cut in the trailing end face 40*a* of the end member 40. The control device 80 controls the operations of the third valve 86 and the fourth valve 89.

Figure 4A:
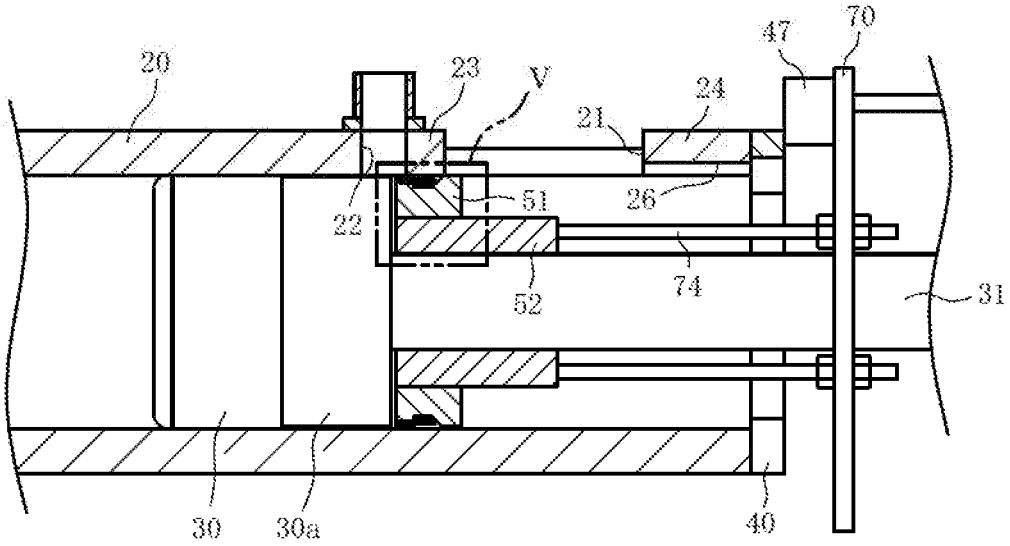
FIG. 4 (*a*) is a cross-sectional view illustrating the casting device after completion of an advancing step.
Figure 4B:
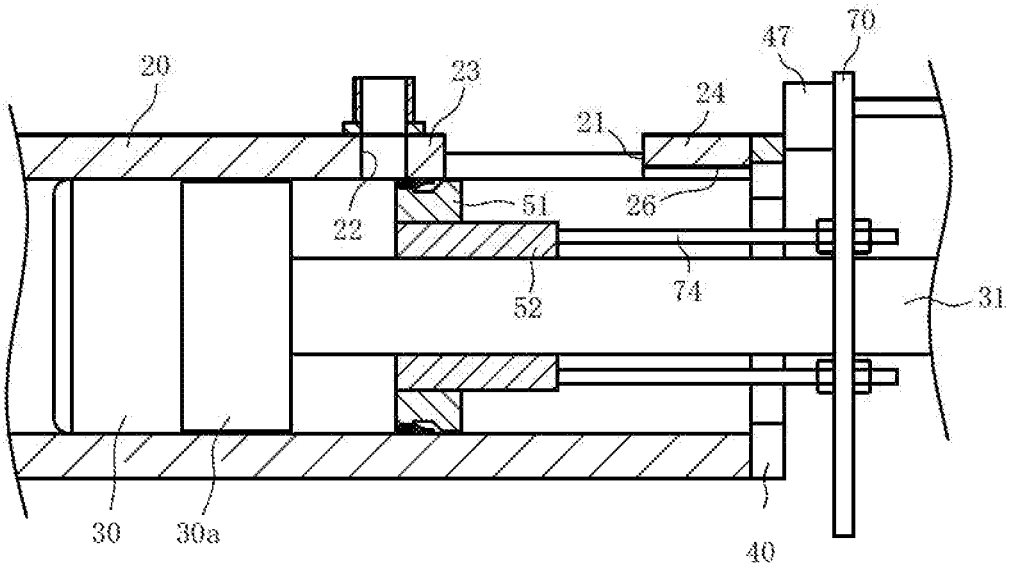

The casting manufacturing operations of the casting device 10 and the structures of the sliding member 50 and the seal member 60 will be described with reference to FIGS. 1 and 4(*a*) to 5. A casting (die-cast product) is manufactured by allowing the casting device 10 to perform mold clamping, injection, and product extrusion. Injection includes a pouring step, an advancing step, a suction step, an injection step, and a retreat step, which are sequentially performed in the order named. FIG. 4(*a*) is a cross-sectional view illustrating the casting device 10 after completion of the advancing step. FIG. 4(*b*) is a cross-sectional view illustrating the casting device 10 during the injection step.

In the pouring step, as depicted in FIG. 1, the tip 30 is positioned inside the trailing end 24 of the sleeve 20 in order to open the pouring hole 21. The sliding member 50 appears outside of the sleeve 20. The first valve 17, the second valve 34, the third valve 86, and the fourth valve 89 are closed. In this state, a molten metal is supplied from the pouring hole 21 to the sleeve 20.

In the advancing step, the injection device 32 extrudes the rod 31 in order to advance the tip 30. Due to the friction between the rod 31 and the sliding member 50, the sliding member 50 also advances together with the tip 30. When the advanced tip 30 reaches the inside of the pouring hole 21 so that the leading end of the tip 30 moves beyond the pouring hole 21 to let the tip 30 close the pouring hole 21, the third valve 86 opens to let the nozzle 87 (first blowing device 82) blow air into the pouring hole 21 (first blowing step).

When the first blowing step is performed, foreign matter, such as metal pieces generated when the molten metal solidifies (e.g., the molten metal dripped from the ladle to the tip 30 and then solidified), is blown away. As a result, the foreign matter is unlikely to be trapped between the sleeve 20 and the sliding member 50, which enters the sleeve 20 after the tip 30. The first section 26 connected to the pouring hole 21 is formed on the inner circumferential surface 25 of the trailing end 24 of the sleeve 20. Therefore, the first section 26 improves the effect of foreign matter removal by the air blown into the pouring hole 21 from the nozzle 87.

Further, the third section 42, which has a greater width (circumferential length) than the pouring hole 21, is formed on the inner surface 41 of the end member 40, and the third section 42, which is connected to the first section 26, has a greater width than the first section 26. Therefore, the air blown from the nozzle 87 removes the foreign matter passing through the first section 26 by blowing it away without being interrupted by the end member 40. Furthermore, the distance between the third section 42 and the central axis O is longer than the distance between the first section 26 and the central axis O. Therefore, the foreign matter passing through the first section 26 is easily removed from the third section 42. The distance between the third section 42 and the central axis O may be equal to the distance between the first section 26 and the central axis O. Even in such a case, the movement of the foreign matter passing through the first section 26 is unlikely to be obstructed by the third section 42.

As depicted in FIG. 4 (*a*), the sliding member 50 stops advancing when the stopper 70, which advances together with the sliding member 50, hits the first stopper 47. The sliding member 50 stops advancing at a position where the tip 30 advances beyond the suction port 22 to let the seal member 60, which is fastened to the sliding member 50, reach the inside of the middle section 23. The position where the sliding member 50 stops advancing is mechanically adjusted depending on the distance between the stopper 70 and the sliding member 50, which are coupled together by the coupling member 74.

When the sliding member 50 stops advancing, the control device 80 opens the second valve 34. As the decompression tank 18 communicates with the suction port 22, air in the sleeve 20 is suctioned from the suction port 22. As the air filter 35 is disposed in the second piping 33 in which the second valve 34 is disposed, it is possible to prevent the foreign matter from reaching the second valve 34 and the decompression tank 18 even if the foreign matter is contained in the air suctioned from the suction port 22.

Figure 5:
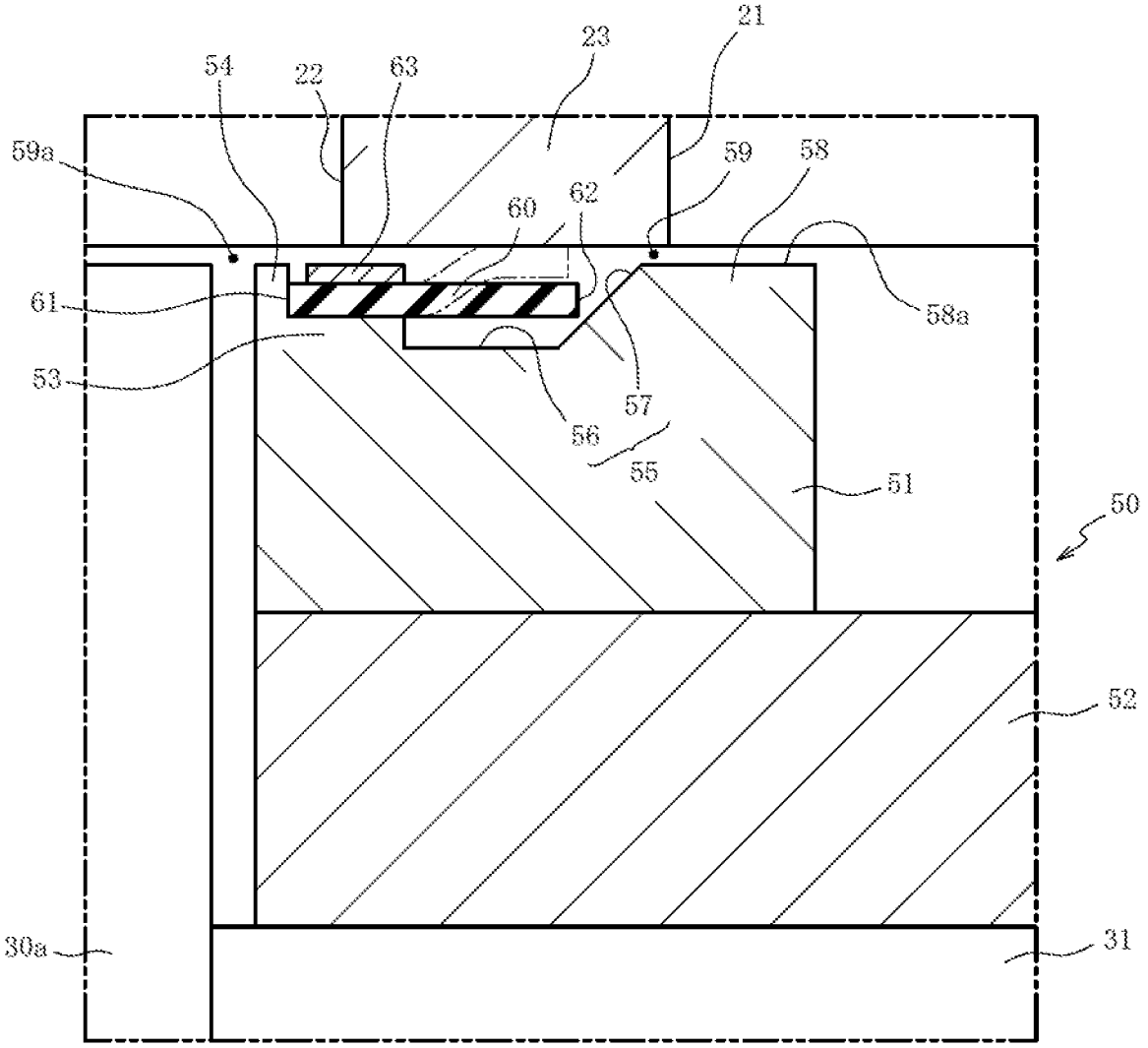
FIG. 5 is an enlarged cross-sectional view illustrating a section of the casting device that is marked by V in FIG. 4(*a*).

FIG. 5 is an enlarged cross-sectional view illustrating a section of the casting device 10 that is marked by V in FIG. 4(*a*). The sliding member 50 includes a cylindrical section 53, a flanged section 54, a concave section 55, and a convex section 58. The seal member 60 is fastened to the outer circumferential surface of the cylindrical section 53. The flanged section 54 is shaped like a flange that is projected radially outward from the leading-end side (left side in FIG. 5) of the cylindrical section 53. The concave section 55 is concaved radially inward from the trailing-end side (right side in FIG. 5) of the cylindrical section 53. The convex section 58 is protruded radially outward from the trailing-end side of the concave section 55.

The concave section 55 includes a cylindrical surface 56 and a conical surface 57. The outside diameter of the cylindrical surface 56 remains unchanged along the central axis O. The outside diameter of the conical surface 57 enlarges toward the trailing-end side. The convex section 58 is disposed on the entire circumference of the sliding member 50. As the diameter of the convex section 58 is smaller than the inside diameter of the sleeve 20, a gap 59 is formed between the outer edge 58*a* (outer circumferential surface) of the convex section 58 and the middle section 23. As the diameter of the flanged section 54 is also smaller than the inside diameter of the sleeve 20, a gap is also formed between the flanged section 54 and the sleeve 20.

The seal member 60 is a belt-like, elastic member having a first edge 61 and a second edge 62. In the present embodiment, the seal member 60 is formed of rubber such as fluororubber. While the first edge 61 abuts on the corner between the cylindrical section 53 and the flanged section 54, the seal member 60 is wound around the entire circumference of the cylindrical section 53 with the opposing ends of a belt of the seal member 60 abutting on each other. A portion of the seal member 60 that is positioned toward the first edge 61 is tightly fastened to the cylindrical section 53 by a metal band 63. Therefore, the portion toward the first edge 61 adheres to the entire circumference of the cylindrical section 53. This releases the second edge 62. While a gap is formed between at least a part of the second edge 62 and the concave section 55 (cylindrical surface 56 and conical surface 57), the seal member 60 is mounted on the cylindrical section 53. In the present embodiment, the second edge 62 of the seal member 60 is positioned toward a leading-end side (right side in FIG. 5) rather than toward the boundary between the cylindrical surface 56 and the conical surface 57.

Figure 6:
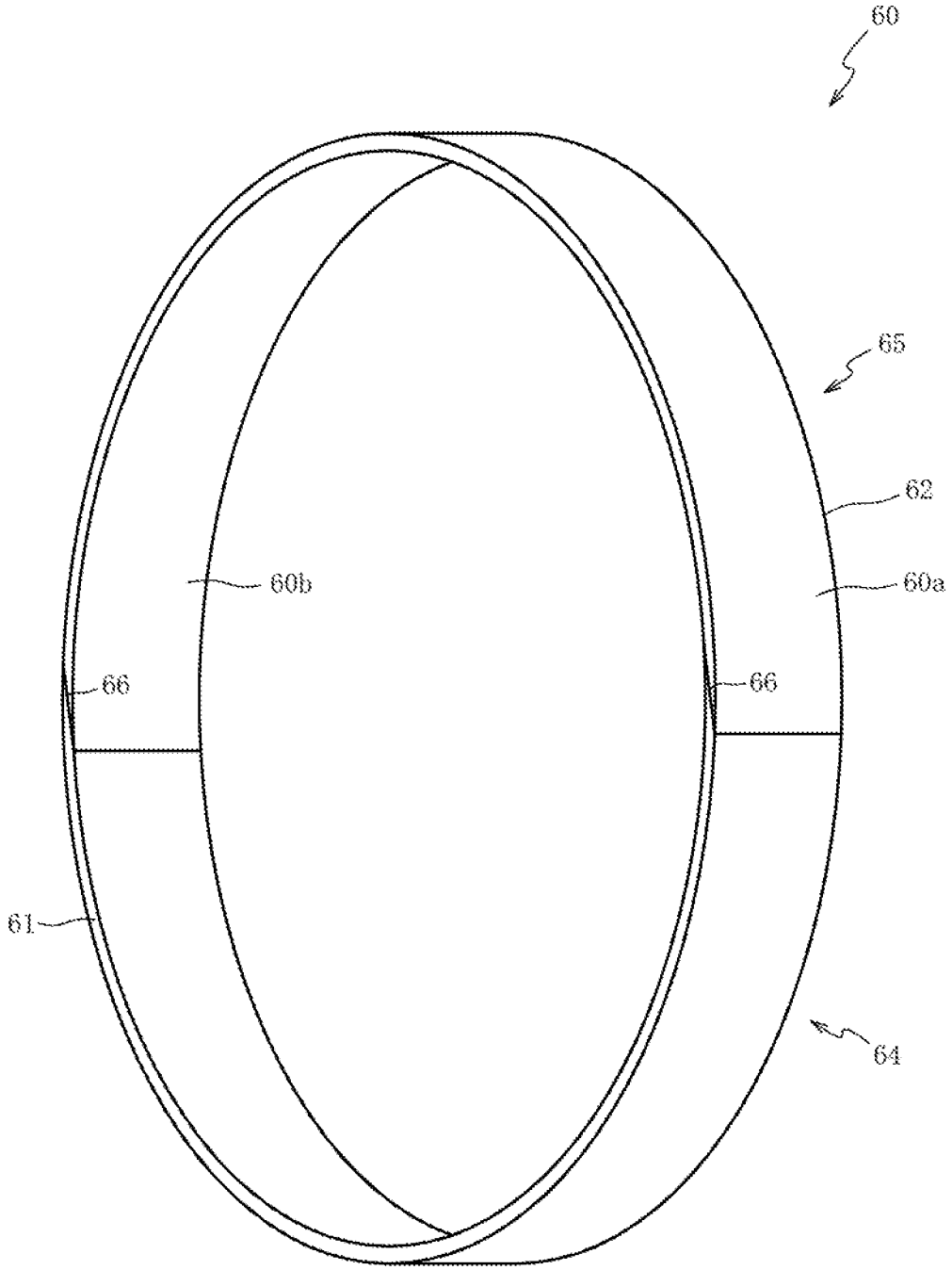
FIG. 6 is a perspective view of a seal member.

FIG. 6 is a schematic perspective view of the seal member 60. The seal member 60 depicted in FIG. 6 is wound around the outer circumference of the sliding member 50. FIG. 6 depicts neither the sliding member 50 (first cylindrical body 51) (see FIG. 5), which adheres to the inner circumferential surface 60*b* of the seal member 60, nor the band 63 (see FIG. 5), which adheres to the outer circumferential surface 60*a* of the seal member 60. In the present embodiment, the seal member 60 includes two members, namely, a first seal 64 and a second seal 65. The circumferential ends 66 of the first seal 64 and the second seal 65 abut on each other.

The ends 66 (cut surfaces) of the first seal 64 and the second seal 65 decrease in thickness toward the circumferential ends. Therefore, as regards the sections of the ends 66 that abut on each other, the two members, namely, the first seal 64 and the second seal 65, overlap with each other within a circumferentially-extended predetermined range from the first edge 61 to the second edge 62.

Returning to FIG. 5, the following description is given. The outer edge 58*a* of the convex section 58 is positioned radially outward from the outer edge of the second edge 62 of the seal member 60 placed in a state where the air in the sleeve 20 is not suctioned (in a later-described second state). The gap 59 exists between the outer edge 58*a* of the convex section 58 and the middle section 23 (sleeve 20). This permits the sliding member 50 and the seal member 60 to advance in the sleeve 20 without rubbing against the sleeve 20.

Consequently, it is possible to smoothly advance the sliding member 50 and prevent the sliding member 50 and the seal member 60 from being worn away by the sleeve 20. Further, even when thermal deformation occurs to warp the sleeve 20 in the longitudinal direction, it is possible to steadily advance the sliding member 50 without having to add a special drive device. Furthermore, the seal member 60 is separated from the sleeve 20. Therefore, even when the foreign matter is attached to the inner surface of the sleeve 20, the foreign matter is unlikely to interfere with the seal member 60. This ensures that the seal member 60 is unlikely to become damaged.

When the displacement sensor 81 detects an abnormality in the displacement (advance) of the sliding member 50, the control device 80 issues an alarm and stops the injection device 32. Therefore, abnormality and breakage can be coped with at an early stage before the progression thereof. This makes it possible to reduce the time required for the investigation of the cause and the recovery operation.

In the suction step, the tip 30 is positioned toward the cavity 14 rather than toward the suction port 22, and the sliding member 50 is positioned in the middle section 23. Therefore, air flows into the suction port 22 from a side toward the second edge 62 of the gap 59 between the middle section 23, the sliding member 50, and the seal member 60 by way of the first edge 61. Such an airflow reduces the pressure in the gap 59, suctions a side toward the second edge 62 of the seal member 60, and causes the second edge 62 to adhere to the middle section 23 (the seal member 60 indicated by a two-dot chain line in FIG. 5). The seal member 60 is pressed against the middle section 23 due to the pressure difference between a space 59*a* between the tip 30 and the sliding member 50 and the gap 59 existing toward the injection device 32 rather than toward the seal member 60. The seal member 60 is then placed in the first state where the seal member 60 receives a force from the middle section 23 as a reaction force.

Further, the sliding member 50 is configured such that the concave section 55 is formed inside the seal member 60. Therefore, the air flowing into the suction port 22 from the gap 59 partly enters the concave section 55 to press the side toward the second edge 62 of the seal member 60 from a radially inward side to a radially outward side. This ensures that the second edge 62 of the seal member 60 adheres more easily to the middle section 23. Furthermore, the concave section 55 is configured such that the conical surface 57 is formed on a trailing-end side (right side in FIG. 5). This ensures that part of the air easily enters the concave section 55. This makes it even easier for the second edge 62 of the seal member 60 to adhere to the middle section 23. Consequently, it is possible to improve the reliability of airtightness provided by the seal member 60.

The ends 66 (cut surfaces) of the seal member 60 decrease in thickness toward the circumferential ends and abut on each other. Therefore, when the side toward the second edge 62 of the seal member 60 is suctioned and adhered to the sleeve 20, no gap is likely to arise relative to a side toward the second edge 62 of the ends 66. This makes it possible to improve airtightness.

In the first state where the seal member 60 adheres to the middle section 23, the pressure in the space 59*a* enclosed by the tip 30 and the seal member 60 decreases approximately to the pressure in the decompression tank 18 (see FIG. 1). Subsequently, the first valve 17 opens to decompress the cavity 14. The pressure in the cavity 14 then decreases approximately to the pressure in the decompression tank 18. As the air filter 36 is disposed in the first piping 16, it is possible to prevent foreign matter from reaching the decompression tank 18 even when the foreign matter is contained in the air flowing in the first piping 16.

In the injection step, as depicted in FIG. 4(*b*), the injection device 32 advances the tip 30 at a speed V1 while the cavity 14 is decompressed, and injects a molten metal into the cavity 14 (first step). The cavity 14 at the time of molten metal injection has substantially the same degree of vacuum as the space 59*a* between the tip 30 and the sliding member 50. This makes it possible to reduce the leakage of air into the cavity 14 from the gap between the tip 30 and the sleeve 20. Consequently, it is possible to reduce the occurrence of blowholes when air is blown into the molten metal.

Further, the space 59*a* between the tip 30 and the sliding member 50 is decompressed. This decreases the amount of air drawn into a molten metal, and thus ensures that the molten metal is not readily pushed out by the air. Therefore, the molten metal is unlikely to be drawn into the cavity 14 before the tip 30 pushes the molten metal into the cavity 14. This makes it possible to reduce the occurrence of blowholes and the occurrence of incomplete fusions between the molten metal earlier drawn into the cavity 14 and the molten metal pushed inward by the tip 30. The space 59*a* in the sleeve 20 and the cavity 14 need not always be decompressed in the above-mentioned order. Obviously, it is possible to change the decompression order so as to decompress the space 59*a* after decompressing the cavity 14.

Next, the injection device 32 further advances the tip 30 at a speed V2 (V2>V1) and injects the molten metal into the cavity 14 (second step). The pressure applied to the cavity 14 in the second step is extremely higher than the pressure (approximately 0.1 MPa) in the space 59*a* in the first step, and the duration of the second step is extremely shorter than the duration of the first step.

Figure 7A:
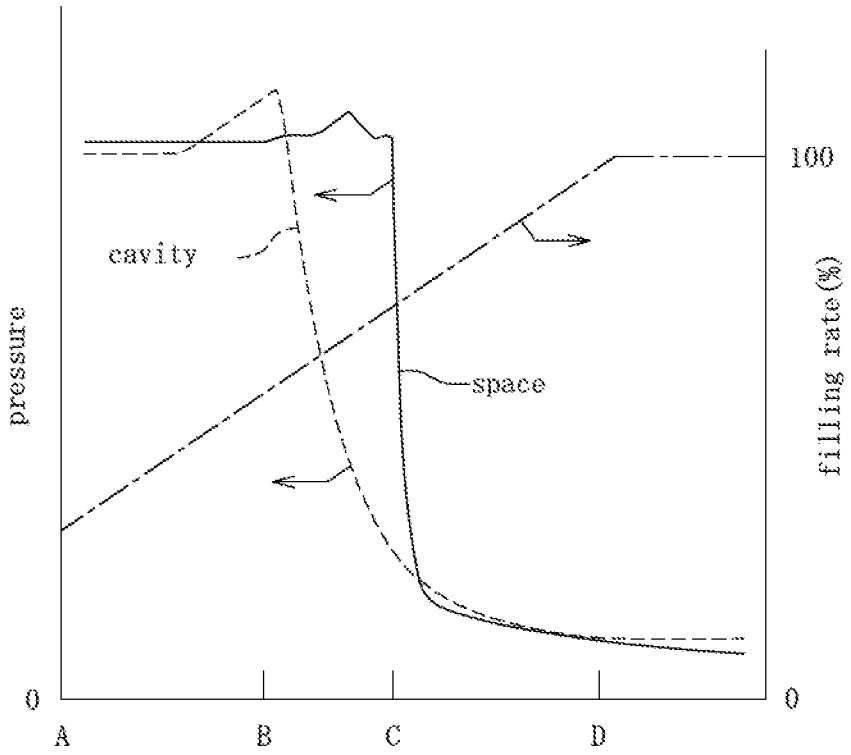
FIG. 7(*a*) illustrates measured pressures in a space between a sliding member and a tip and measured pressures in a cavity.
Figure 7B:
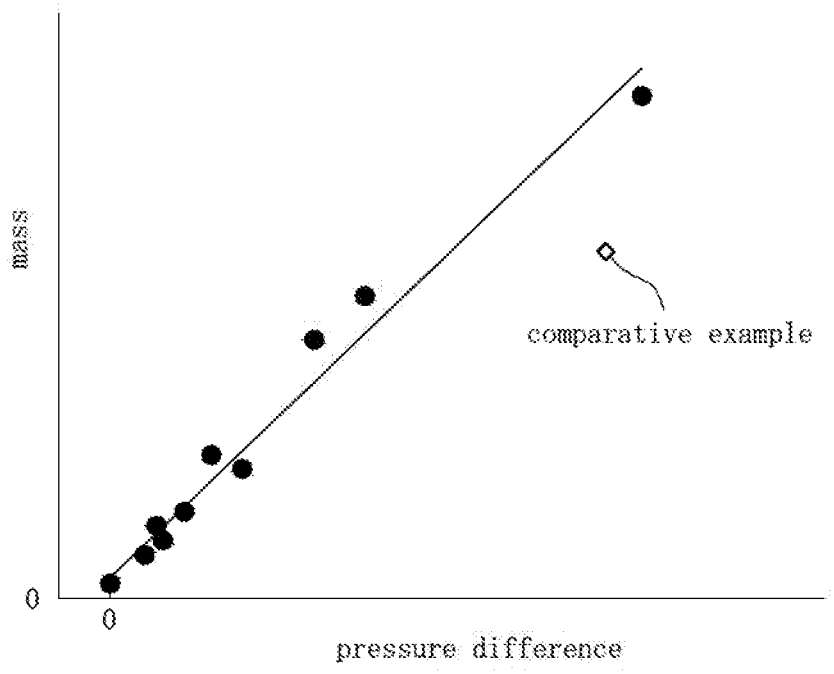

Referring to FIG. 7, results of measurements of the pressure in the casting device 10 and the mass of the molten metal drawn into the cavity 14 will be described. FIG. 7(*a*) illustrates the results of measurements of the pressure in the space 59*a* in the casting device 10 and the pressure in the cavity 14. FIG. 7(*b*) is a correlation diagram illustrating the relationship between the pressure difference between the cavity 14 and the space 59*a* and the mass of the molten metal drawn into the cavity 14.

In FIG. 7 (*a*), the first vertical axis indicates the pressures in the cavity 14 and the space 59*a*, the second vertical axis indicates the filling rate of the molten metal in the sleeve 20, and the horizontal axis indicates the steps. Point A of the horizontal axis represents a time when a molten metal is poured into the sleeve 20 from the pouring hole 21. Point B represents the beginning of the decompression of the cavity 14. Point C represents the beginning of the suctioning of the space 59*a*. Point D represents the end of the first step (a time when the filling rate is 98%). The second step begins at point D. As regards the casting device 10, it is confirmed at point D that the pressure difference between the space 59*a* and the cavity 14 is substantially zero (approximately 1 kPa).

The correlation diagram in FIG. 7 (*b*) is obtained from the results of measurements made to measure the mass of a molten metal drawn into the cavity 14 when injection is experimentally stopped at the end of the first step (point D in FIG. 7(*a*)). In FIG. 7(*b*), the horizontal axis indicates the pressure difference between the space 59*a* and the cavity 14 at the end of the first step (point D in FIG. 7(*a*)). The vertical axis indicates the mass of the molten metal drawn into the cavity 14 from the sleeve 20.

As depicted in FIG. 7(*b*), in the casting device 10, there is a high positive correlation between the pressure difference between the space 59*a* and the cavity 14 and the mass of the molten metal drawn into the cavity 14. As the casting device 10 is able to ensure that the pressure difference between the space 59*a* and the cavity 14 is substantially zero at the end of the first step (see FIG. 7 (*a*)), it is confirmed that the amount of molten metal drawn into the cavity 14 can be extremely reduced. Consequently, the casting device 10 is able to manufacture a casting that is not significantly affected by the occurrence of blowholes and the occurrence of incomplete fusions between the molten metal drawn into the cavity 14 and the molten metal pushed inward by the tip 30.

A comparative example depicted in FIG. 7 (*b*) indicates the result obtained from a casting device having a rod provided with a tip configured such that a ring sliding in a sleeve is disposed on the outer circumference of the tip instead of the omitted sliding member 50. The comparative example indicates the results of measurements made at a filling rate of 98% to measure the pressure difference between a cavity and a space in the sleeve positioned toward an injection device rather than toward the ring disposed on the tip and the mass of a molten metal drawn into the cavity. It is found that the casting device in the comparative example exhibits a greater pressure difference at a filling rate of 98% than the casting device 10 and exhibits a greater mass of the molten metal drawn into the cavity than the casting device 10. When compared to the casting device in the comparative example, the casting device 10 is able to reduce the pressure difference between the space 59*a* and the cavity 14, and is thus suitable for manufacturing high-quality castings.

Returning to FIG. 1, the following description is given. After the molten metal is injected, the second valve 34 is operated to interrupt the communication between the suction port 22 and the decompression tank 18 to open the suction port 22 to air pressure. The pressure in the space 59*a* (see FIG. 5) between the tip 30 and the sliding member 50 then reverts to air pressure. The pressure in the space 59*a* forward of the seal member 60 is then equal to the pressure in a space rearward of the seal member 60. Therefore, the force of pressing the seal member 60 against the middle section 23 is lost. As a result, the elastic force of the seal member 60 returns it to the second state (the seal member 60 indicated by a solid line in FIG. 5) where the second edge 62 is separated from the middle section 23.

Consequently, it is possible to prevent the seal member 60 from coming into contact with the middle section 23 during curing. During such a period, thermal transfer and thermal radiation occur from the sleeve 20 to the seal member 60. However, it is possible to avoid thermal conduction from the sleeve 20 to the seal member 60. As compared to a case where the seal member 60 is in contact with the sleeve 20 during the entire period of product casting, it is possible to shorten the period of time during which thermal conduction occurs from the sleeve 20 to the seal member 60. This makes it possible to reduce the thermal degradation of the seal member 60.

After completion of the first step of the injection step and before the second step, the second valve 34 can be operated to open the suction port 22 to air pressure. The reason is that, even when the space 59*a* is not decompressed, it is possible to avoid leakage between the tip 30 and the sleeve 20 depending on the speed V2 of the tip 30 and other conditions.

After the molten metal in the cavity 14 is solidified, the mold 11 is opened to let the extrusion device (not shown) remove a product (casting). In preparation for the next molding process, the injection device 32 pulls back the rod 31 so as to let the tip 30 retreat (retreat step). The diameter of the sliding member 50 and the diameter of the seal member 60 in the second state are smaller than the diameter of the sleeve 20. Therefore, the friction between the seal member 60 and the sleeve 20 and the friction between the sliding member 50 and the sleeve 20 are ignorable. Consequently, in the retreat step, when the rod 31 is pulled back, the sliding member 50, which is secured by friction to the rod 31, retreats while maintaining a spacing interval from the tip 30.

In some cases, foreign matter (e.g., metal pieces) may remain in the vicinity of the pouring hole 21. However, the convex section 58 is disposed toward a trailing-end side (right side in FIG. 5) rather than toward the seal member 60. Therefore, the convex section 58 reaches the pouring hole 21 before the seal member 60. The outer edge 58*a* of the convex section 58 is positioned radially outward from the outer edge of the seal member 60 in the second state. Therefore, the foreign matter left in the vicinity of the pouring hole 21 can be scraped off so that the foreign matter is unlikely to be trapped by the seal member 60. This makes it possible to inhibit the seal member 60 from being damaged. The foreign matter scraped off from the sleeve 20 by the convex section 58 (sliding member 50) is discharged out of the sleeve 20 via the fifth section 44 of the end member 40. It is preferable that air be blown from the nozzle 87 at the beginning of the retreat of the sliding member 50 in order to discharge the foreign matter left in the vicinity of the pouring hole 21 out of the sleeve 20 before the passage of the sliding member 50.

A bit before the sliding member 50 begins to leave the sleeve 20, the casting device 10 opens the fourth valve 89 (second blowing device 83) to blow air to the sliding member 50 (second blowing step). The second blowing step is able to remove the foreign matter attached to the sliding member 50 and the seal member 60. This makes it possible to prevent the foreign matter attached to the sliding member 50 and the seal member 60 from being brought into the sleeve 20 during the next molding process. Consequently, it is possible to inhibit the foreign matter from being trapped between the sliding member 50 and the sleeve 20 and between the seal member 60 and the sleeve 20.

Further, as the seal member 60 is air-cooled in the second blowing step, it is possible to reduce the thermal degradation of the seal member 60. The air flows from the fourth piping 88 to the grooves 45, 47*a* in the end member 40, and the grooves 45, 47*a* are extended in the circumferential direction. Therefore, the air can be blown widely in the circumferential direction of the sliding member 50 and the seal member 60. This makes it possible to further remove the foreign matter from the sliding member 50 and the seal member 60 and further cool the seal member 60.

When the retreat of the stopper 70 is restricted by the second stopper 49, the sliding member 50 stops retreating. Even when the retreat of the sliding member 50 stops, the rod 31 is continuously pulled back. Therefore, the tip 30 continues to retreat until it is positioned behind the pouring hole 21. There is a gap between the sliding member 50 and a surface of the retreated and stopped tip 30 (coupling 30*a*) that is positioned toward the sliding member 50. This ensures that foreign matter is unlikely to be trapped between the sliding member 50 and the coupling 30*a*. If foreign matter is placed between the sliding member 50 and the coupling 30*a*, the foreign matter is trapped by the sliding member 50 and the coupling 30*a* so that the foreign matter is brought into the sleeve 20 during the next molding process. The above-described scheme is adopted to avoid such a problem. Further, if foreign matter is trapped between the sliding member 50 and the coupling 30*a*, the stopper 70, the second stopper 49, and other parts may become damaged because the tip 30 (coupling 30*a*) may retreat the sliding member 50 via the foreign matter and press the stopper 70 against the second stopper 49 via the coupling member 74. The above-described scheme is adopted to avoid such a problem.

Figure 8:
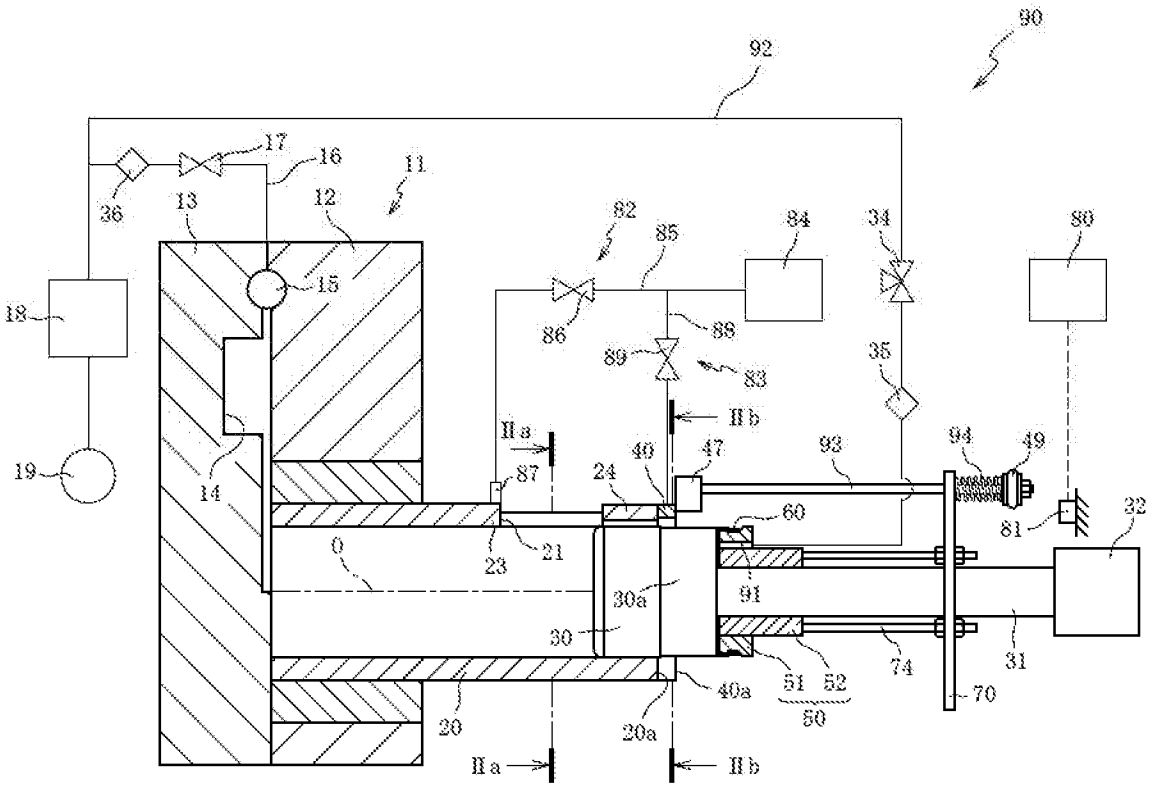
FIG. 8 is a cross-sectional view of the casting device according to a second embodiment of the present invention.

With reference to FIG. 8, a second embodiment will be described. In the first embodiment, the case where the suction port 22 is formed in the sleeve 20 has been described. In the second embodiment, the case where a suction port 91 is formed in the sliding member 50 will be described. The same parts as those described in the first embodiment are denoted by the same reference characters, and the description thereof is omitted. FIG. 8 is a cross-sectional view of a casting device 90 according to the second embodiment.

The casting device 90 is configured such that the suction port 91, which axially penetrates the sliding member 50, is formed in the sliding member 50. The suction port 91 is an opening for suctioning air in the sleeve 20. The suction port 91 is connected to a second piping 92. The second valve 34 and the air filter 35 are disposed in the second piping 92. The second piping 92 is connected to the decompression tank 18 downstream of the second valve 34. At least a part of the second piping 92 is formed of a flexible tube. Therefore, the second piping 92 does not obstruct the movement of the sliding member 50. The casting device 90 according to the second embodiment provides the same advantageous effects as in the casting device 10 according to the first embodiment.

Further, an arm 93 is fastened to the first stopper 47. The arm 93 is longer than the stopper 70 and is linearly extended toward the injection device 32. A spring 94 is disposed between the stopper 70 and the second stopper 49, which is fastened to the trailing end of the arm 93. In the present embodiment, the spring 94 is a compression spring formed of metal. The elastic force of the spring 94 that attempts to move the stopper 70 and the second stopper 49 away from each other is greater than the friction force between the rod 31 and the sliding member 50, and is smaller than the force exerted by the injection device 32 to retreat the tip 30 via the rod 31.

Accordingly, when the stopper 70 retreats in the retreat step due to the friction force between the rod 31 and the sliding member 50, the spring 94 restricts the retreat of the stopper 70 together with the second stopper 49 because the elastic force of the spring 94 is greater than the friction force between the rod 31 and the sliding member 50. This stops the retreat of the sliding member 50.

As the friction force between the rod 31 and the sliding member 50 is smaller than the force exerted by the injection device 32 to retreat the tip 30 via the rod 31, the rod 31 is continuously pulled back even when the sliding member 50 stops its retreat. Even if large foreign matter is trapped between the sliding member 50 and the coupling 30*a* so that the tip 30 (coupling 30*a*) retreats the sliding member 50 via the foreign matter, it is possible to prevent the stopper 70 from being pressed against the second stopper 49 via the coupling member 74 due to the deformation of the spring 94. This makes it possible to prevent the stopper 70, the second stopper 49, and other parts from being damaged.

Although the present invention has been described with reference to the embodiments, the present invention is not necessarily limited to the above embodiments at all. It can be easily understood that various modifications can be devised without departing from the gist of the present invention.

In the above embodiments, the case where the sliding member 50 includes the first cylindrical body 51 and the second cylindrical body 52, which is fitted into the first cylindrical body 51 has been described. However, the present invention is not necessarily limited thereto. As a matter of course, the sliding member 50 may be formed without being divided into a plurality of members, namely, the first cylindrical body 51 and the second cylindrical body 52.

In the above embodiments, the case where the inner circumferential surface of the sliding member 50 (second cylindrical body 52) entirely comes into contact with the rod 31 to cause friction between the sliding member 50 and the rod 31 and thus ensure airtightness between the sliding member 50 and the rod 31 has been described. However, the present invention is not necessarily limited thereto. As a matter of course, for example, a packing such as an O-ring may be interposed between the sliding member 50 and the rod 31 to ensure airtightness, and a check ball having a ball attached to the leading end of a spring may be disposed between the sliding member 50 and the rod 31, and the sliding member 50 may be coupled to the rod 31 by engagement of a ball. The check ball disengages from the sliding member 50 when the rod 31 advances, and engages with the sliding member 50 when the rod 31 retreats.

In the above embodiments, the case where the decompression tank 18 for decompressing the cavity 14 is used as a suction device for suctioning air from the suction port 22 of the sleeve 20 has been described. However, the present invention is not necessarily limited thereto. As a matter of course, a suction device (e.g., vacuum pump or decompression tank) for suctioning air from the suction port 22 of the sleeve 20 may be installed separately from the decompression tank 18.

In the above embodiments, the case where a decompression tank or other suction device is disposed outside of the sleeve 20 has been described. However, the present invention is not necessarily limited thereto. When, for example, the tip 30 further advances with respect to the sliding member 50 that has entered toward the cavity 14 rather than toward the pouring hole 21 in the sleeve 20 without the suction port 22, the space 59*a* between the sliding member 50 and the tip 30 is decompressed so that air flows into the space 59*a* from the gap 59 between the sleeve 20 and the sliding member 50. Such an airflow reduces the pressure in the gap 59, suctions a side of the seal member 60 that is positioned toward the second edge 62, and allows the second edge 62 to adhere to the middle section 23. In this case, a suction device, such as a decompression tank, need not be installed outside of the sleeve 20 because the tip 30 doubles as a suction device.

In the above embodiments, the case where the fourth piping 88 of the second blowing device 83 is connected to the groove 45 in the end member 40 has been described. However, the present invention is not necessarily limited thereto. As a matter of course, a nozzle may be provided as is the case with the first blowing device 82, and the nozzle may be disposed at such a position that blown air hits the sliding member 50 when it leaves the sleeve 20. The nozzle may be mounted on the first stopper 47 or on a separately disposed bracket.

In the above embodiments, the case where the nozzle 87 of the first blowing device 82 is disposed on the outer circumference of the middle section 23 has been described. However, the present invention is not necessarily limited thereto. As a matter of course, for example, the nozzle 87 oriented toward the pouring hole 21 so as to blow air toward the injection device 32 may be disposed on the outer circumference of the trailing end 24 of the sleeve 20. Also, a bracket may be separately disposed and the nozzle 87 may be attached to the bracket.

In the above embodiments, the case where the belt-like seal member 60 formed of rubber is disposed on the sliding member 50 has been described. However, the present invention is not necessarily limited thereto. Various types of seal member may be adopted as appropriate as far as they are able to switch between two different states, namely, the first state where the adopted seal member adheres to the middle section 23 when air is suctioned from the suction port 22, and the second state where the adopted seal member receives a smaller force from the middle section 23 than the force received from the middle section 23 in the first state. When the above condition is met, as a matter of course, lip packing may be used or other materials such as thermoplastic elastomer may be adopted as the seal member.

In the above embodiments, the case where the seal member 60 is divided into two members, namely, the first seal 64 and the second seal 65 has been described. However, the present invention is not necessarily limited thereto. The number of members into which the seal member 60 is divided is set as appropriate depending, for example, on the thickness of the seal member 60 and the size of the gap between the sliding member 50 and the sleeve 20. If, for example, the gap between the sliding member 50 and the sleeve 20 is small, the seal member 60 need not be divided because the ends 66 abutting on each other do not need to have a great circumferential length. In such a case, as regards the cut surfaces of the seal member 60 (ends 66), the thickness of the seal member 60 is gradually decreased toward both circumferential ends, and the seal member 60 is wound around the sliding member 50 with the ends 66 adapted to abut on each other.

In the above embodiments, the case where the seal member 60 is separated from the middle section 23 in the second state where the seal member receives a smaller force from the middle section 23 than the force received from the middle section 23 by the seal member in the first state where the seal member adheres to the middle section 23 has been described. However, the present invention is not necessarily limited thereto. The reason is that, even if the seal member is in contact with the middle section 23 in the second state, it is possible to ensure airtightness in the first state during injection and reduce the wear of the seal member in the second state during movement as far as the seal member receives a greater force from the middle section 23 than the force received from the middle section 23 by the seal member in the second state when air is suctioned from the suction port 22 to establish the first state where the seal member adheres to the middle section 23.

In the above embodiments, the case where the coupling member 74 is formed by a plurality of rod-shaped first members 75 has been described. However, the present invention is not necessarily limited thereto. As a matter of course, the coupling member may be formed by using a cylindrical member or a plate-like member.

In the above embodiments, exemplifying a horizontal mold clamping horizontal injection cold chamber die casting machine, the seal structure applied thereto has been described. However, the present invention is not necessarily limited thereto. As a matter of course, the seal structure may be also applicable to other casting devices such as a horizontal mold clamping, vertical injection die cast machine, a vertical mold clamping, vertical injection die cast machine, and a hot chamber die cast machine.

In the above embodiments, the seal structure in which the sliding member 50 is the first member and the sleeve 20 is the second member has been described. However, the present invention is not necessarily limited thereto. As a matter of course, a member with a cross-section having a circular outer circumferential surface may be used as the first member, and a member with a cross-section having a circular inner circumferential surface may be used as the second member.

In the above embodiments, the seal structure in which the seal member 60 disposed on the outer peripheral surface of the sliding member 50 (first member) closely contacts the inner peripheral surface of the sleeve 20 (second member) to close the gap has been described. However, the present invention is not necessarily limited thereto. As a matter of course, for example, a seal structure may be adopted where a belt-like seal member is disposed on the inner circumferential surface and end face of the second member to suction air in the gap between the first and second members, thereby adhering the seal member to the end face of the first member and closing the gap. Similarly, as a matter of course, a seal structure may be adopted where a belt-like seal member is disposed on the outer circumferential surface and end face of the first member to suction air in the gap between the first and second members, thereby adhering the seal member to the end face of the second member and closing the gap.

In the second embodiment, the case where a metal compression spring (coil spring) is used as the spring 94 for moving the stopper 70 and the second stopper 49 away from each other has been described. However, the present invention is not necessarily limited thereto. As a matter of course, a compression spring other than a coil spring may be used or the position of the spring 94 may be changed to use a tension spring as the spring 94. Further, as a matter of course, instead of a metal spring, an air spring, a rubber elastic body, or a spring formed of synthetic resin may be used.

The each embodiments may be modified, for example, by adding one or more elements included in an embodiment to another embodiment or by replacing one or more elements included in an embodiment with one or more elements included in another embodiment. For example, the arm 48 and the second stopper 49, which are described in conjunction with the first embodiment, may obviously be replaced by the arm 93, the spring 94, and the second stopper 49, which are described in conjunction with the second embodiment.

The invention claimed is:

1. A casting device comprising:

a sleeve that communicates with a cavity of a mold to be decompressed, and has a pouring hole;

a tip that is to be inserted into the sleeve;

a rod that is to be mounted on the tip;

an injection device that applies a force to the tip via the rod;

a sliding member that slides with the rod centrally to form a gap between the sliding member and the sleeve, wherein the rod slides through a center of the sliding member;

a seal member that is disposed on the outer circumference of the sliding member; and a suction device that suctions air in the sleeve;

wherein, when air in a space between the tip and the sliding member in the sleeve is suctioned while the seal member is positioned in a middle section of the sleeve that is positioned toward the cavity rather than toward the pouring hole, the seal member is placed in a first state where the seal member adheres to the middle section;

wherein, before the air in the space is suctioned while the seal member is positioned in the middle section, the seal member is placed in a second state where the seal member receives a smaller force from the middle section than the force received from the middle section by the seal member in the first state; and wherein, in the first state, the tip advances toward the cavity.

2. The casting device according to claim 1, wherein, in the second state, a gap is formed between the seal member and the middle section.

3. The casting device according to claim 1, wherein the seal member is a member having a first edge and a second edge; wherein a side toward the first edge adheres to an entire circumference of the sliding member; and wherein the second edge is disposed toward the injection device rather than toward the first edge and is released.

4. The casting device according to claim 3, wherein the edges of the seal member gradually decrease in thickness toward a circumferential end and then abut on each other.

5. The casting device according to claim 3, wherein the sliding member is configured such that a concave is formed inside the second edge of the seal member; and wherein a gap exists between the concave and at least a part of the second edge in the second state.

6. The casting device according to claim 1, wherein the sliding member includes a convex disposed on the outer circumference that is positioned toward the injection device rather than toward the seal member; and wherein an outer edge of the convex is positioned radially inward of an outer edge of the seal member in the first state, and is positioned radially outward of the outer edge of the seal member in the second state.

7. The casting device according to claim 1, further comprising:

a first blowing device that blows air into the pouring hole.

8. The casting device according to claim 7, wherein an inner circumferential surface of a trailing end of the sleeve that is adjacent to the pouring hole and positioned toward the injection device includes a first section and a second section, the first section overlapping with the pouring hole in direction of a central axis of the sleeve, the second section being adjacent to the first section in a circumferential direction of the sleeve and in contact with an outer circumferential surface of the tip; and wherein the distance between the first section and the central axis of the sleeve is longer than the distance between the second section and the central axis.

9. The casting device according to claim 8, further comprising:

an end member disposed on an end of the sleeve that is positioned toward the injection device;

wherein an inner surface of the end member that faces the central axis of the sleeve includes a third section and a fourth section, the third section partly overlapping with a range over which the pouring hole is extended toward the injection device along the central axis, the fourth section being adjacent to the third section in the circumferential direction of the sleeve; and wherein the distance between the third section and the central axis is longer than the distance between the fourth section and the central axis.

10. The casting device according to claim 9, further comprising:

a second blowing device for blowing air;

wherein a groove is formed in the end member to provide passage of the air blown from the second blowing device; and wherein at least a part of the groove is extended in the circumferential direction of the sleeve.

11. The casting device according to claim 1, further comprising:

a second blowing device for blowing air to the sliding member protruded from an end of the sleeve that is positioned toward the injection device.

12. The casting device according to claim 1, further comprising:

an air filter that is disposed in a piping connected to the suction device.

13. The casting device according to claim 1, further comprising:

a stopper that is disposed toward the injection device rather than toward the sliding member;

a coupling member that couples the stopper to the sliding member;

a first stopper that is brought into contact with the stopper to restrict advance of the sliding member toward the cavity rather than toward the middle section; and a second stopper that is disposed toward the injection device rather than toward the first stopper;

wherein the stopper comes into contact with the second stopper to restrict retreat of the sliding member toward the injection device;

wherein the sliding member moves together with the rod due to friction between the sliding member and an outer circumferential surface of the rod; and wherein, when retreating toward the injection device rather than toward the pouring hole, the tip stops at a position where a gap exists between the sliding member stopped due to contact between the second stopper and the stopper and a surface of the tip that is positioned toward the sliding member.

14. The casting device according to claim 1, wherein the sleeve is configured such that a suction port is formed toward the cavity rather than toward the pouring hole; wherein the suction port is connected to the suction device; and wherein the middle section is positioned between the pouring hole and the suction port.

* * * * *